US007139471B1

(12) United States Patent
Durham

(10) Patent No.: US 7,139,471 B1
(45) Date of Patent: Nov. 21, 2006

(54) APPARATUS FOR REMOVING SNOW/ICE FROM A ROOF

(76) Inventor: Brian Durham, 6396 Frank Turner Way, Paradise, CA (US) 95969

( * ) Notice: Subject to any disclaimer, the term of this patent is extended or adjusted under 35 U.S.C. 154(b) by 0 days.

(21) Appl. No.: 10/962,231

(22) Filed: Oct. 12, 2004

(51) Int. Cl.
*F24H 9/00* (2006.01)

(52) U.S. Cl. ..... 392/437; 219/213; 392/435

(58) Field of Classification Search ..... 392/435–437; 219/213, 541, 528–529, 549
See application file for complete search history.

(56) References Cited

U.S. PATENT DOCUMENTS

| | | | | |
|---|---|---|---|---|
| 2,546,743 | A | 3/1951 | Harrison | |
| 2,699,484 | A | 1/1955 | Michaels | |
| 2,844,696 | A * | 7/1958 | Custer, Jr. | 219/213 |
| 3,129,316 | A | 4/1964 | Glass et al. | |
| 3,521,029 | A | 7/1970 | Toyooka et al. | |
| 4,009,743 | A * | 3/1977 | Ackerman | 81/45 |
| 4,769,526 | A | 9/1988 | Taouil | |
| 5,387,778 | A * | 2/1995 | Stanger | 219/213 |
| 5,451,743 | A * | 9/1995 | du Preez | 219/200 |
| 5,813,184 | A * | 9/1998 | McKenna | 52/518 |
| 5,900,178 | A | 5/1999 | Johnsen | |
| 6,294,768 | B1 * | 9/2001 | Liebich | 219/528 |
| 6,348,673 | B1 | 2/2002 | Winters | |
| 6,653,607 | B1 * | 11/2003 | Ellis et al. | 219/528 |
| 6,727,471 | B1 * | 4/2004 | Evans et al. | 219/213 |

FOREIGN PATENT DOCUMENTS

| | | | |
|---|---|---|---|
| DE | 3609782 | * | 6/1987 |
| JP | 46-26018 | * | 7/1971 |
| JP | 53-18237 | * | 2/1978 |
| JP | 2-118335 | * | 5/1990 |
| WO | 02/034094 | * | 5/2002 |

* cited by examiner

*Primary Examiner*—Thor S. Campbell

(57) ABSTRACT

An apparatus for removing snow and ice from a roof includes a plurality of heating panels fastened to a rooftop surface. Each heating panel is formed from water-impermeable material and includes top and bottom surfaces formed from heat-resistant material. A plurality of elongated thermal-conductive heating elements are sandwiched medially of the top and bottom surfaces. A control panel is electrically coupled to one of the heating panels and a power cord is electrically coupled to an external power supply source. The present invention further includes a mechanism for electrically coupling the heating panels to each other and a mechanism for removably attaching the heating panels to the roof. A thermal sensor is operably connected to the control panel and the heating panels for monitoring an operating temperature of the heating elements.

14 Claims, 6 Drawing Sheets

APPARATUS FOR REMOVING SNOW/ICE FROM A ROOF

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to a heating apparatus and, more particularly, to an apparatus for removing snow/ice from a roof.

2. Prior Art

During winter time, a substantial amount of snow may accumulate on the roof of a building. Some of the snow on the roof may melt and then freeze to ice along the gutters, forming "ice dams". As the ice in the gutters or eaves builds up, any water accumulating at the lower portion of the roof may be forced back and up and may get under the shingles of the roof, thereby leading to leaks if the ice is not removed from the roof. It is known to throw salt pellets onto the roof to assist in melting some of the snow or ice from the roof. However, the salt pellets are small and dissolve after only melting a small area at the upper portion of the snow, and thus are ineffective at melting the ice dams formed at the lower or shingle level of the snow and ice on the roof, since the lower layers of ice may be thick and/or may be beneath a substantial amount of snow.

It is also known to place a number of salt pellets into a mesh netting, such as a nylon stocking or the like, and throw the salt pellets and netting onto the roof. Because there is a substantial amount of salt pellets within the mesh netting, all of the salt pellets do not dissolve before they melt a substantial amount of the snow or ice in the area in which they were placed. However, the mesh netting only melts down to the level of the roof and does not melt any ice along the roof, since the mesh netting does not slide along the incline of the roof. Also, after the salt pellets have dissolved, the mesh netting is left on the roof and may clog the eves or the down spouts if not removed.

In some situations, a person may chisel at the snow or ice and/or shovel the snow or ice off the roof manually, either independent of any other ice removal technique or after placing salt pellets onto the roof to melt at least some of the snow and ice. Such an approach is very difficult and dangerous to accomplish because the person shoveling or chiseling the snow must be at or on the rooftop where they may easily slip and fall.

Accordingly, a need remains for an apparatus for removing snow/ice from a roof in order to overcome the above-noted shortcomings. The present invention satisfies such a need by providing a roof heating apparatus that is easily installed, convenient and effective, and eliminates the hazardous task of removing the ice or snow manually. Such an apparatus increases the life span of a roof by ensuring the integrity of the roof shingles is not diminished by the extreme temperatures created by the ice. An individual can either install and remove the apparatus once a year or install it once and leave it on the roof permanently.

BRIEF SUMMARY OF THE INVENTION

In view of the foregoing background, it is therefore an object of the present invention to provide an apparatus for removing snow/ice from a roof. These and other objects, features, and advantages of the invention are provided by a transportable apparatus positionable on a rooftop for dissipating heat along a surface area thereof.

The apparatus includes a plurality of heating panels for being selectively fastened to at least one portion of a rooftop surface. Each heating panel has a centrally disposed longitudinal axis and is formed from heat-resistant and water-impermeable material. A plurality of oppositely positioned apertures may be provided for effectively receiving a fastening member therethrough. Such heating panels include top and bottom surfaces formed from flexible, heat-resistant material such that the heating panels can advantageously conform to uneven rooftop surfaces. A plurality of elongated thermal-conductive heating elements are sandwiched medially of the top and bottom surfaces and extend along rectilinear paths disposed substantially parallel to the axis. Each of the heating elements preferably includes a pair of conductive end terminals for being electrically mated to the power cord.

A control panel is electrically coupled to one of the heating panels and includes a power cord electrically coupled to an external power supply source. Such a control panel selectively regulates an operating temperature of the heating elements such that a user may advantageously cause the heating elements to heat the rooftop surface and melt undesirable ice and snow therefrom. The control panel is conveniently mountable to a support surface adjacent to a ground level so that a user can operate the heating panels therefrom. The control panel preferably includes a user interface and a microprocessor electrically coupled thereto.

Such an interface allows a user to input a selected data parameter for operating the heating panels. The microprocessor receives the user input and generates a corresponding output signal such that the heating elements are caused to generate a selected level of heat for effectively elevating a surface temperature of the heating panels respectively. A mechanism for electrically coupling the heating panels to each other is also included such that one heating panel defines a conduit through which power is supplied to other ones of the heating panels.

A mechanism is also included for removably attaching the heating panels such that selected ones of the heating panels can be maintained at a substantially stable position without being directly fastened to the rooftop surface. Such an attaching mechanism preferably includes a plurality of removably engageable male and female adaptors disposed along opposed sides of the heating panels such that adjacently positioned heating panels can be locked together while juxtaposed along the rooftop surface.

A thermal sensor is operably connected to the control panel and the heating panels for monitoring an operating temperature of the heating elements such that a user can identify whether the operating temperature should be adjusted during periodic intervals. The transportable apparatus may further include a portable hand-operable implement for advantageously assisting a user to maneuver the heating panels during installation procedures.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
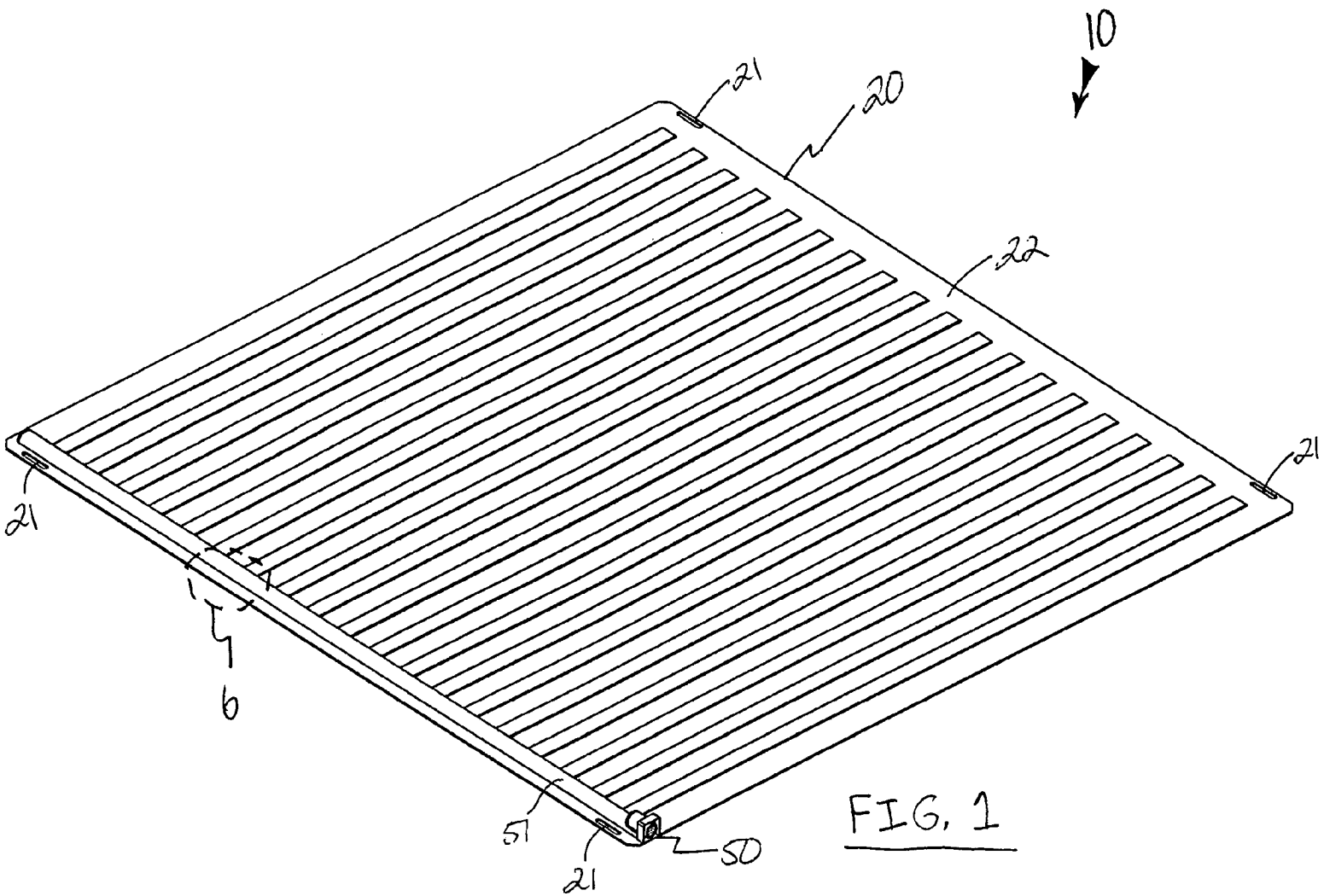
FIG. 1 is a perspective view showing a heating panel for removing snow/ice from a roof, in accordance with the present invention.
Figure 2:
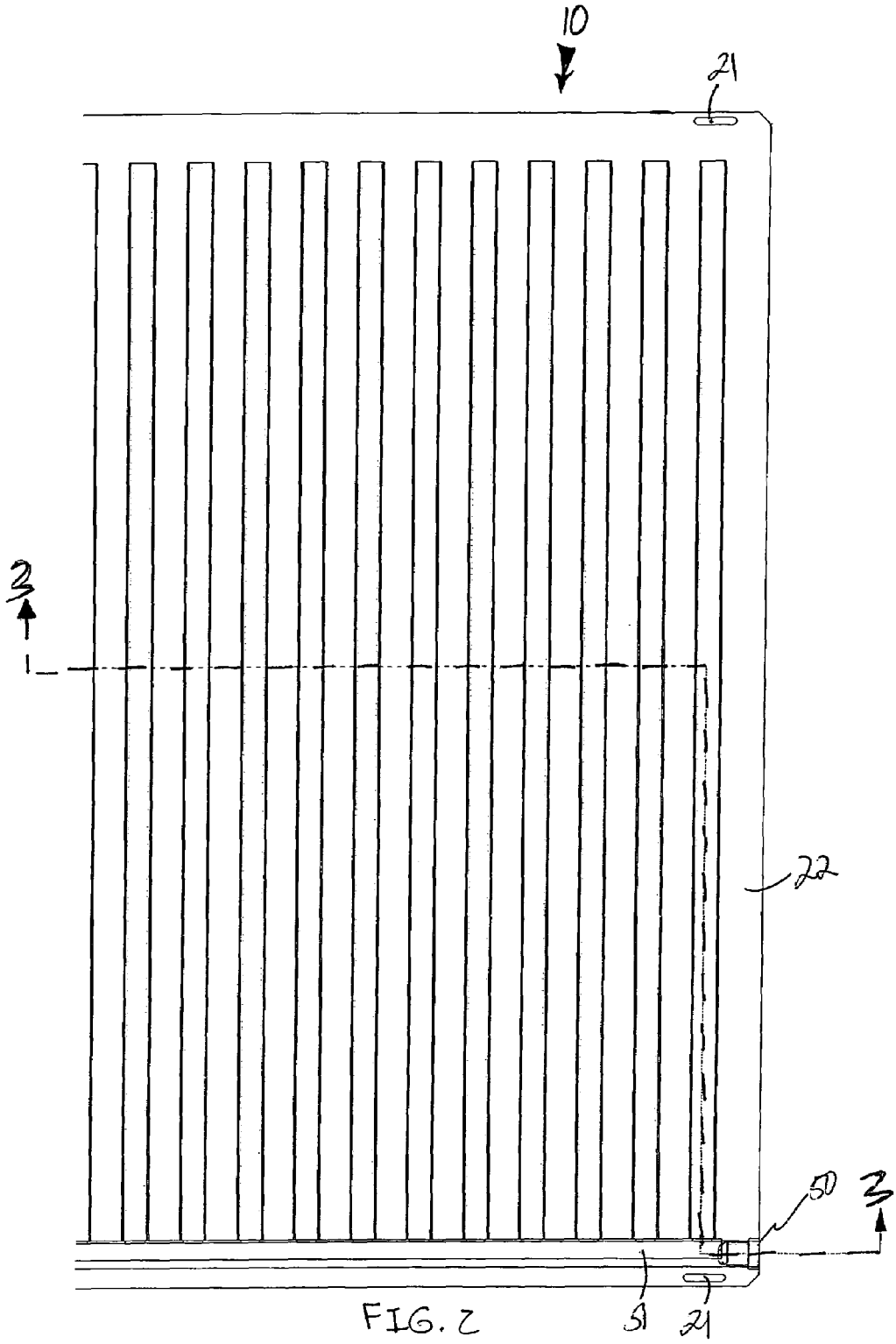
FIG. 2 is a partially enlarged top plan view of the apparatus shown in FIG. 1.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus of this invention is referred to generally in FIGS. 1–9 by the reference numeral 10 and is intended to provide an apparatus for removing snow/ice from a roof. It should be understood that the apparatus 10 may be used to remove snow/ice from many different types of surfaces and should not be limited to only roofs.

Referring initially to FIGS. 1, 2, 4, and 6, the apparatus 10 includes a plurality of heating panels 20 selectively fastened to at least one portion of a rooftop surface. The heating panels 20 are preferably formed ABS UV stabilized sheets having a 0.0625 thickness. Each heating panel 20 has a centrally disposed longitudinal axis and is formed from heat-resistant and water-impermeable material. Having a plurality of panels 20 advantageously allows an individual to cover roofs of varying sizes and thus enables the apparatus 10 to be applied to many different houses. A plurality of oppositely positioned apertures 21 is provided for effectively receiving a fastening member (not shown) therethrough if a user wishes to attach the apparatus 10 as a permanent fixture to the roof. Such heating panels 20 include top 22 and bottom 23 surfaces formed from flexible, heat-resistant material such that the heating panels 20 can advantageously conform to uneven rooftop surfaces.

Figure 3:
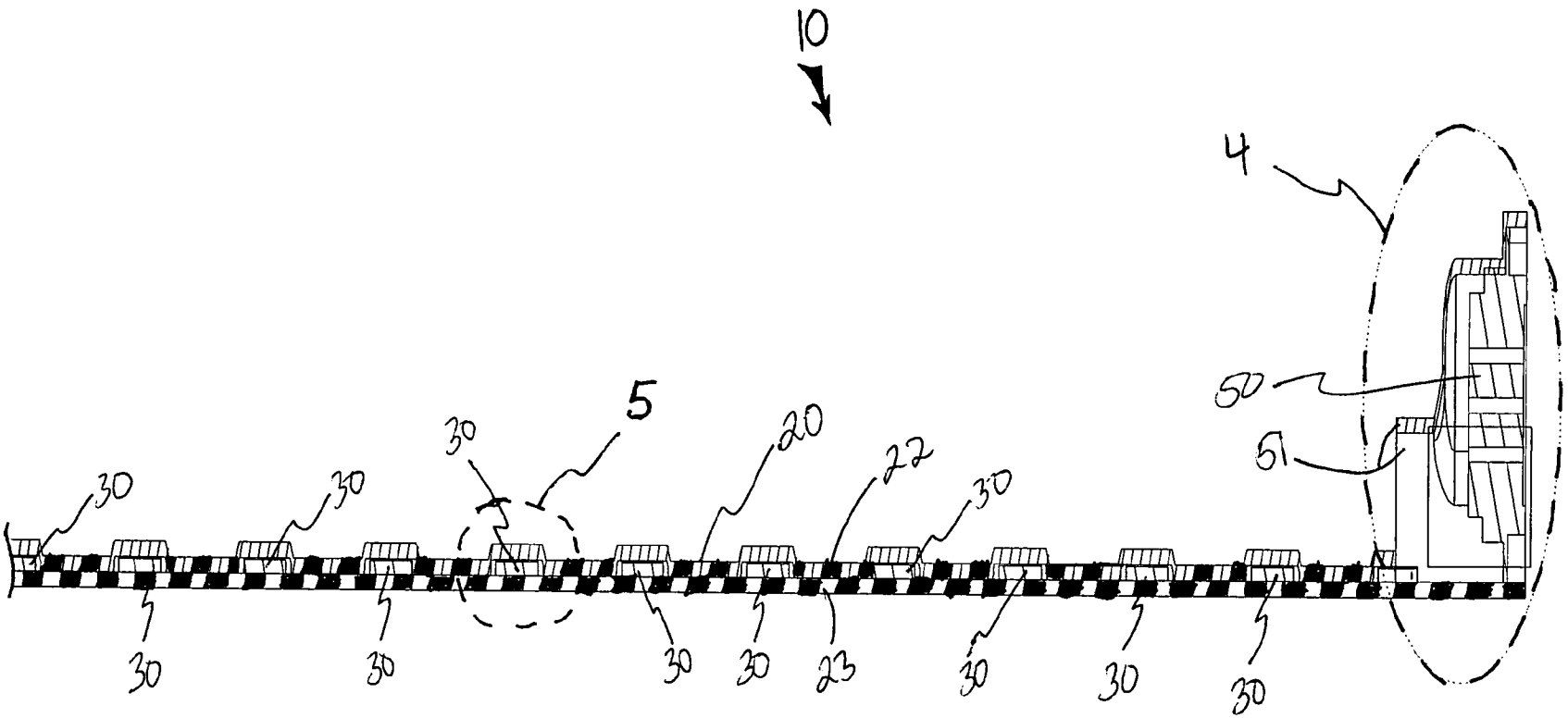
FIG. 3 is an enlarged cross-sectional view of the apparatus shown in FIG. 2, taken along line 3—3.
Figure 6:
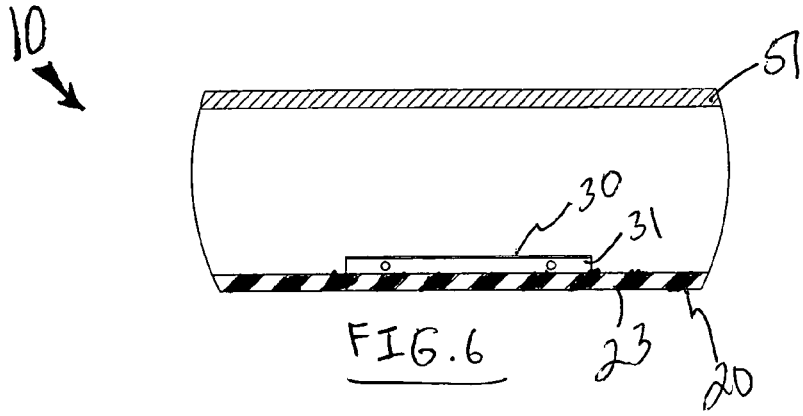
FIG. 6 is an enlarged cross-sectional view showing the conductive end terminals of the heating elements.
Figure 5:
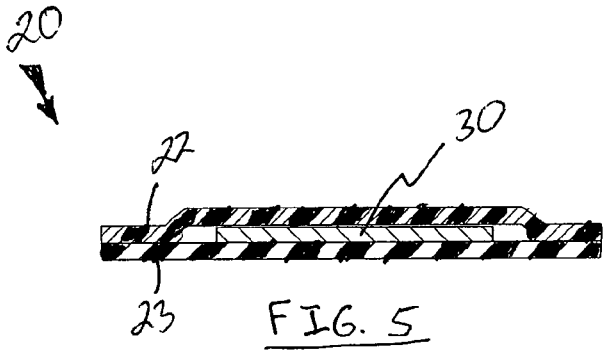
FIG. 5 is an enlarged cross-sectional view of the heating element shown in FIG. 3.
Figure 4:
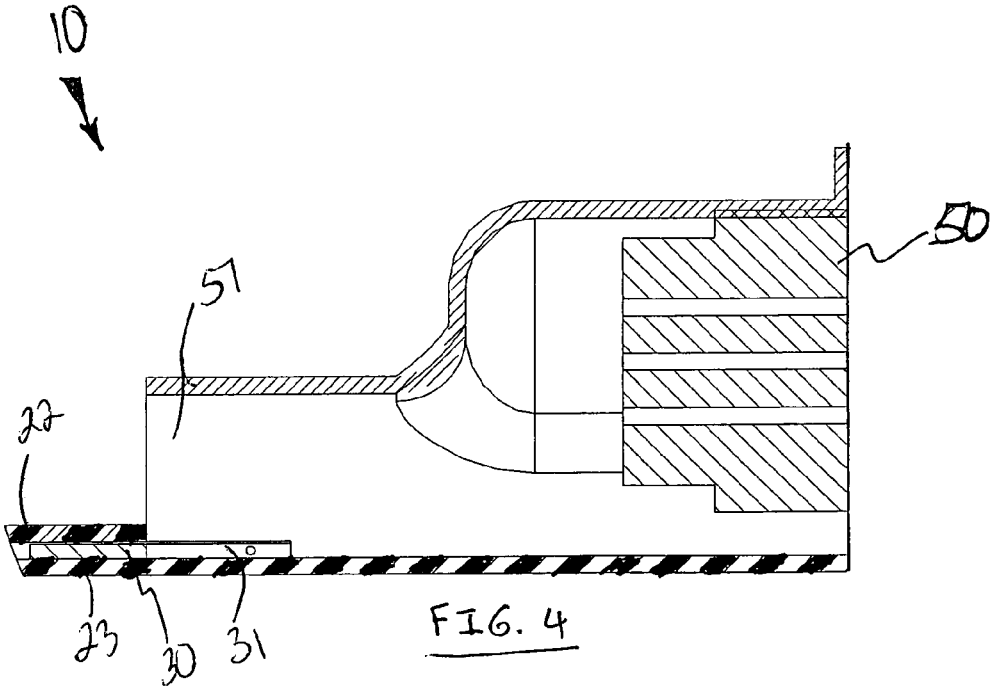
FIG. 4 is an enlarged cross-sectional view of the electric coupling mechanism shown in FIG. 3.

A plurality of elongated thermal-conductive heating elements 30 are sandwiched medially of the top 22 and bottom 23 surfaces and extend along rectilinear paths disposed substantially parallel to the axis, as best shown in FIGS. 3 and 5. Each of the heating elements 30 includes a pair of conductive end terminals 31 electrically mated to the power cord 41 (described herein below). Such heating elements 30 most preferably include the Watlow DD04 custom type heating elements provide energy efficient heat and may also include a safety thermostat for monitoring the heat temperature. Of course, other well known heating elements may be employed by the present invention without departing from the true scope thereof.

Figure 9:
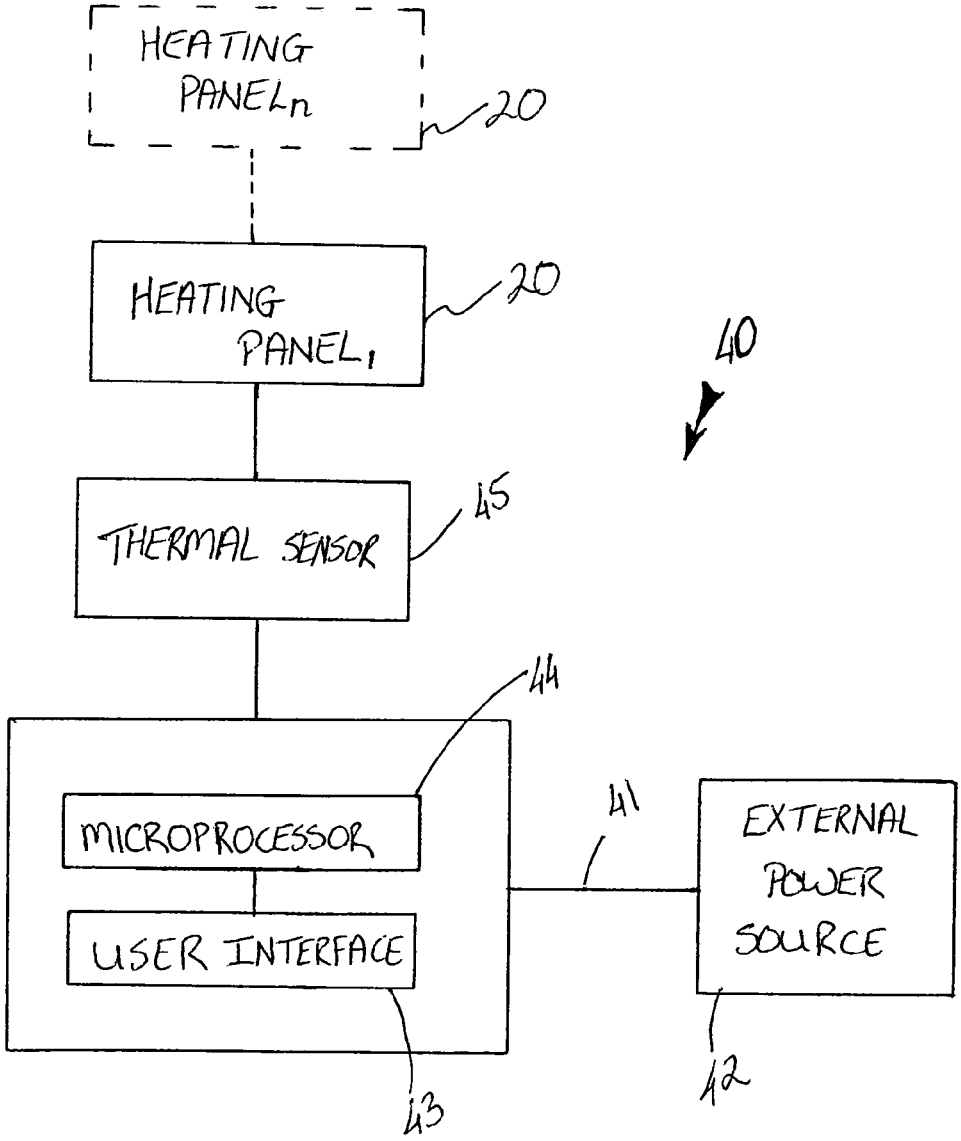
FIG. 9 is a schematic block diagram of the control panel and its associated heating panels.

Referring to FIG. 9, a control panel 40 is electrically coupled to one of the heating panels 20 and includes a power cord 41 electrically coupled to an external power supply source 42. Such a control panel 40 selectively regulates an operating temperature of the heating elements 30 such that a user may advantageously cause the heating elements 30 to heat the rooftop surface and melt undesirable ice and snow therefrom without the need for manual labor. The control panel 40 is conveniently mountable to a support surface adjacent to a ground level so that a user can easily operate the heating panels 20 therefrom. A Watlow Series C temperature controller and Series TM temperature indicator are preferably employed by the present invention.

The control panel 40 includes a user interface 43 and a microprocessor 44 electrically coupled thereto. Such an interface 43 allows a user to input a selected data parameter for operating the heating panels 20, conveniently allowing a user to program the apparatus 10 accordingly to the type of weather they are experiencing. The microprocessor 44 receives the user input and generates a corresponding output signal such that the heating elements 30 are caused to generate a selected level of heat for effectively elevating a surface temperature of the heating panels 20 respectively. A mechanism 50 for electrically coupling the heating panels 20 to each other is also included such that one heating panel 20 defines a conduit 51 through which power is supplied to other ones of the heating panels 20.

Figure 7:
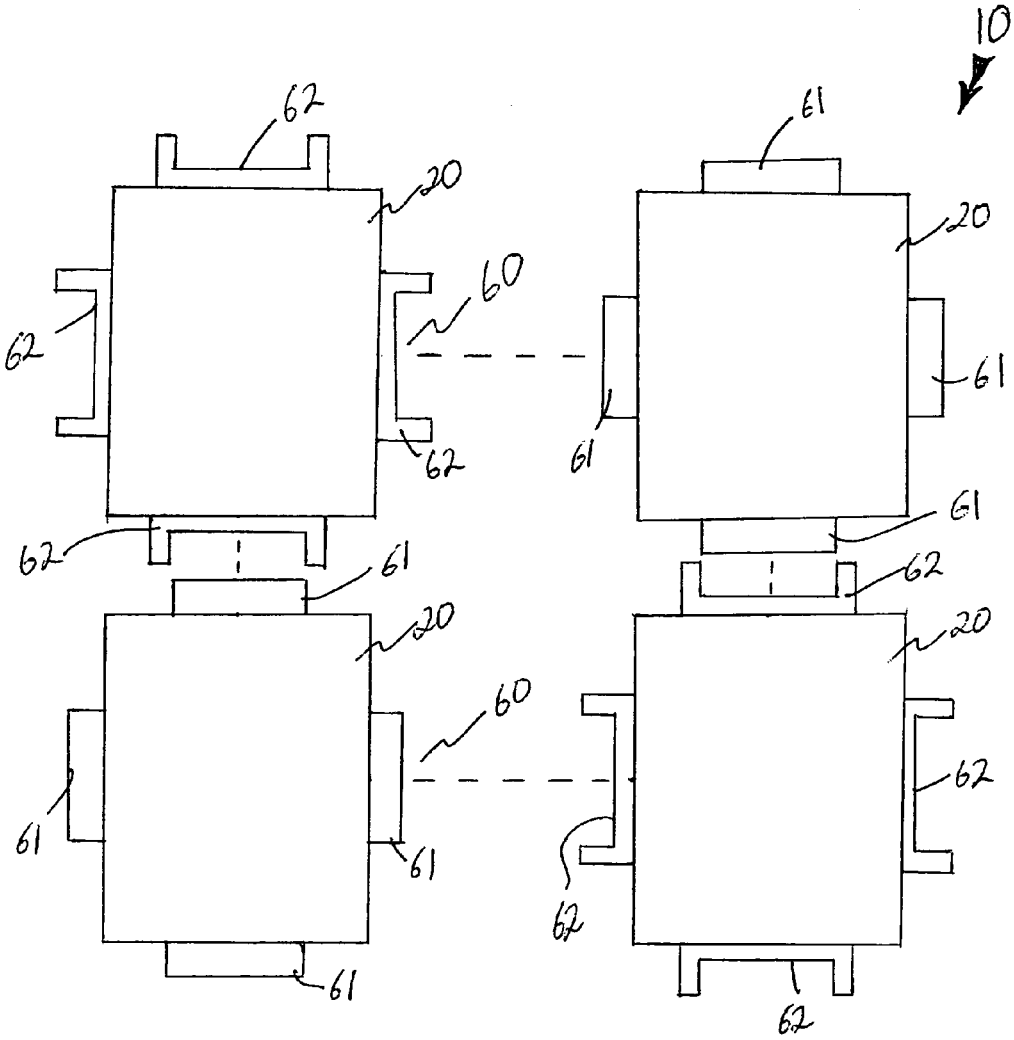
FIG. 7 is a top plan view showing a plurality of heating panels with their associated male and female adaptors.

Referring to FIG. 7, a mechanism 60 is also included for removably attaching the heating panels 20 such that selected ones of the heating panels 20 can be maintained at a substantially stable position without being directly fastened to the rooftop surface if a home owner does not wish to attach the apparatus 10 as a permanent fixture. Such an attaching mechanism 60 includes a plurality of removably engageable male 61 and female 62 adaptors disposed along opposed sides of the heating panels 20 such that adjacently positioned heating panels 20 can be locked together while juxtaposed along the rooftop surface.

Figure 8:
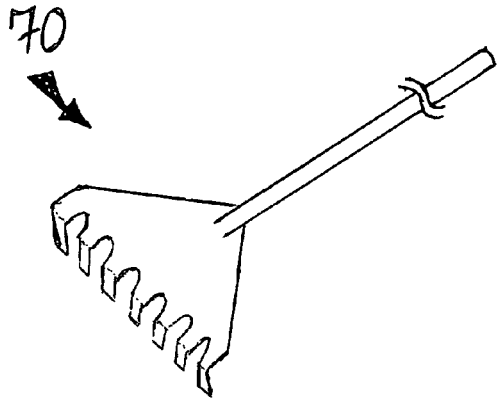
FIG. 8 is a perspective view of the portable hand-operable implement.

Referring to FIG. 9, a thermal sensor 45, such as the Watlow Enviroseal RTD sensor, is operably connected to the control panel 40 and the heating panels 20 for monitoring an operating temperature of the heating elements 30 such that a user can identify whether the operating temperature should be adjusted during periodic intervals. The transportable apparatus 10 further includes a portable hand-operable implement 70 for advantageously assisting a user to maneuver the heating panels 20 during installation procedures, as illustrated in FIG. 8. Such a hand-operable implement allows a user to manipulate heating panels 20 that may be out of arm's reach, advantageously eliminating the need to climb onto the roof for installing the panels 20.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A transportable apparatus positionable on a rooftop for dissipating heat along a surface area thereof, said apparatus comprising:

a plurality of heating panels for being selectively fastened to at least one portion of the rooftop surface, each said heating panel having a centrally disposed longitudinal axis and comprising top and bottom surfaces formed from heat-resistant material and being flexible such that said heating panels can conform to uneven rooftop surfaces, and a plurality of thermal-conductive heating elements sandwiched medially of said top and bottom surfaces and extending along rectilinear paths disposed substantially parallel to the axis;

a control panel electrically coupled to one of said heating panels and including a power cord electrically coupled to an external power supply source, said control panel for selectively regulating an operating temperature of said heating elements such that a user may cause said heating elements to heat the rooftop surface and melt undesirable ice and snow therefrom;

means for electrically coupling said heating panels to each other such that said one heating panel defines a conduit through which power is supplied to other ones of said heating panels;

means for removably attaching said heating panels such that selected ones of said heating panels can be maintained at a substantially stable position without being directly fastened to the rooftop surface, wherein said attaching means comprises a plurality of removably engageable male and female adaptors disposed along opposed sides of said heating panels such that adjacently positioned heating panels can be locked together while juxtaposed along the rooftop surface, each of said heating panels having first and second oppositely facing sides extending parallel to each other, each of said heating panels further having third and fourth oppositely facing sides extending parallel to each other wherein said first and second sides are registered orthogonal to said third and fourth sides respectively, selected ones of said heating panels having first, second, third and fourth ones of said female adaptors directly abutted against said first, second, third and fourth sides respectively, each of said first, second, third and fourth female adaptors having coextensive U-shapes facing outwardly from said selected heating panels, other ones of said heating panels having first, second, third and fourth ones of said male adaptors directly abutted against said first, second, third and fourth sides thereof respectively, said first, second, third and fourth male adaptors being removably and directly interfittable within said first, second, third and fourth female adaptors respectively such that said selected heating panels can be interchangeably rotated and locked with said other heating panels at each of said first, second, third and fourth sides respectively, a thermal sensor operably connected to said control panel and said heating panels for monitoring an operating temperature of said heating elements such that a user can identify whether the operating temperature should be adjusted during periodic intervals; and a portable hand-operable implement for assisting a user to maneuver said heating panels during installation procedures.

2. The apparatus of claim 1, wherein said control panel comprises:

a user interface and a microprocessor electrically coupled thereto, said interface for allowing a user to input a selected data parameter for operating said heating panels, said microprocessor for receiving said user input and generating a corresponding output signal such that said heating elements are caused to generate a selected level of heat for elevating a surface temperature of said heating panels respectively.

3. The apparatus of claim 1, wherein each of said heating panels is provided with a plurality of oppositely positioned apertures for receiving a fastening member therethrough.

4. The apparatus of claim 1, wherein each of said heating elements comprises: a pair of conductive end terminals for being electrically mated to said power cord.

5. A transportable apparatus positionable on a rooftop for dissipating heat along a surface area thereof, said apparatus comprising:

a plurality of heating panels for being selectively fastened to at least one portion of the rooftop surface, each said heating panel having a centrally disposed longitudinal axis and being formed from heat-resistant and water-impermeable material, said heating panels comprising top and bottom surfaces formed from heat-resistant material and being flexible such that said heating panels can conform to uneven rooftop surfaces, and a plurality of thermal-conductive heating elements sandwiched medially of said top and bottom surfaces and extending along rectilinear paths disposed substantially parallel to the axis;

a control panel electrically coupled to one of said heating panels and including a power cord electrically coupled to an external power supply source, said control panel for selectively regulating an operating temperature of said heating elements such that a user may cause said heating elements to heat the rooftop surface and melt undesirable ice and snow therefrom;

means for electrically coupling said heating panels to each other such that said one heating panel defines a conduit through which power is supplied to other ones of said heating panels;

means for removably attaching said heating panels such that selected ones of said heating panels can be maintained at a substantially stable position without being directly fastened to the rooftop surface, wherein said attaching means comprises a plurality of removably engageable male and female adaptors disposed along opposed sides of said heating panels such that adjacently positioned heating panels can be locked together while juxtaposed along the rooftop surface; and a thermal sensor operably connected to said control panel and said heating panels for monitoring an operating temperature of said heating elements such that a user can identify whether the operating temperature should be adjusted during periodic intervals; and a portable hand-operable implement for assisting a user to maneuver said heating panels during installation procedures, wherein said implement has a linear handle and an actuating head monolithically formed therewith, said actuating head having a pair of outwardly diverging sides equidistantly spaced from said handle, said actuating head further having a plurality of coextensively shaped teeth equidistantly spaced along a distal end of said actuating head and intermediately seated between said pair of sides, each of said teeth having a first portion extending parallel to a top face of said actuating head and further having a second portion extending downwardly therefrom, wherein said first and second portions are registered orthogonal to each other.

6. The transportable apparatus of claim 5, wherein said control panel comprises:

a user interface and a microprocessor electrically coupled thereto, said interface for allowing a user to input a selected data parameter for operating said heating panels, said microprocessor for receiving said user input and generating a corresponding output signal such that said heating elements are caused to generate a selected level of heat for elevating a surface temperature of said heating panels respectively.

7. The transportable apparatus of claim 5, wherein each of said heating panels is provided with a plurality of oppositely positioned apertures for receiving a fastening member therethrough.

8. The transportable apparatus of claim 5, wherein each of said heating elements comprise: a pair of conductive end terminals for being electrically mated to said power cord.

9. A transportable apparatus positionable on a rooftop for dissipating heat along a surface area thereof, said apparatus comprising:

a plurality of heating panels for being selectively fastened to at least one portion of the rooftop surface, each said heating panel having a centrally disposed longitudinal axis and being formed from heat-resistant and water-impermeable material, each of said heating panels comprising top and bottom surfaces formed from heat-resistant material and being flexible such that said heating panels can conform to uneven rooftop surfaces, and a plurality of elongated thermal-conductive heating elements sandwiched medially of said top and bottom surfaces and extending along rectilinear paths disposed substantially parallel to the axis;

a control panel electrically coupled to one of said heating panels and including a power cord electrically coupled to an external power supply source, said control panel for selectively regulating an operating temperature of said heating elements such that a user may cause said heating elements to heat the rooftop surface and melt undesirable ice and snow therefrom, said control panel being mountable to a support surface adjacent ground level so that a user can operate said heating panels therefrom;

means for electrically coupling said heating panels to each other such that said one heating panel defines a conduit through which power is supplied to other ones of said heating panels;

means for removably attaching said heating panels such that selected ones of said heating panels can be maintained at a substantially stable position without being directly fastened to the rooftop surface; and a thermal sensor operably connected to said control panel and said heating panels for monitoring an operating temperature of said heating elements such that a user can identify whether the operating temperature should be adjusted during periodic intervals;

wherein one of said heating elements is spaced below a top wall of said conduit.

10. The transportable apparatus of claim 9, wherein said control panel comprises:

a user interface and a microprocessor electrically coupled thereto, said interface for allowing a user to input a selected data parameter for operating said heating panels, said microprocessor for receiving said user input and generating a corresponding output signal such that said heating elements are caused to generate a selected level of heat for elevating a surface temperature of said heating panels respectively.

11. The transportable apparatus of claim 9, wherein said attaching means comprises:

a plurality of removably engageable male and female adaptors disposed along opposed sides of said heating panels such that adjacently positioned heating panels can be locked together while juxtaposed along the rooftop surface.

12. The transportable apparatus of claim 9, wherein each of said heating panels is provided with a plurality of oppositely positioned apertures for receiving a fastening member therethrough.

13. The transportable apparatus of claim 9, wherein each of said heating elements comprise: a pair of conductive end terminals for being electrically mated to said power cord.

14. The transportable apparatus of claim 9, further comprising: a portable hand-operable implement for assisting a user to maneuver said heating panels during installation procedures.

* * * * *